US006264256B1

(12) United States Patent
Hankel et al.

(10) Patent No.: US 6,264,256 B1
(45) Date of Patent: Jul. 24, 2001

(54) CLOSING SYSTEM

(75) Inventors: Willi Hankel, Waldeck; Günter Uhlmann, Höchberg, both of (DE)

(73) Assignee: Hewi Heinrich Wilke GmbH, Bad Arolsen (DE)

( * ) Notice: Subject to any disclaimer, the term of this patent is extended or adjusted under 35 U.S.C. 154(b) by 0 days.

(21) Appl. No.: 09/365,347

(22) Filed: Jul. 30, 1999

(30) Foreign Application Priority Data

Jul. 31, 1998 (DE) ..... 198 34 691

(51) Int. Cl.[7] ..... E05C 17/04
(52) U.S. Cl. ..... 292/336.3; 70/278.1
(58) Field of Search ..... 70/277, 278.1, 70/278.3, 279.1, 280, DIG. 31; 292/336.3; 340/825.31

(56) References Cited

U.S. PATENT DOCUMENTS

| | | | | |
|---|---|---|---|---|
| 4,832,385 | | 5/1989 | Llort | 292/144 |
| 4,901,545 | * | 2/1990 | Bacon | 70/278 |
| 5,010,752 | * | 4/1991 | Lin | 70/277 |
| 5,040,391 | | 8/1991 | Lin | 70/277 |
| 5,609,051 | * | 3/1997 | Donaldson | 70/278 |
| 5,712,626 | * | 1/1998 | Andreou | 340/825.31 |
| 5,970,759 | * | 10/1999 | Trilk | 70/277 |

FOREIGN PATENT DOCUMENTS

| | | |
|---|---|---|
| 578670 | 8/1976 | (CH) . |
| 577758 | 6/1933 | (DE) . |
| 3347896C2 | 2/1986 | (DE) . |
| 36 02 989 A1 | 11/1987 | (DE) . |
| 42 34 321 A1 | 4/1994 | (DE) . |
| 295 11 547 U1 | 1/1997 | (DE) . |
| WO 97/04203 | 2/1997 | (DE) . |
| 19612156C2 | 7/1998 | (DE) . |
| 0 505 084 A1 | 9/1992 | (EP) . |
| 0 588 209 A1 | 3/1994 | (EP) . |
| WO 97/30252 | 8/1997 | (WO) . |

* cited by examiner

*Primary Examiner*—Gary W. Estremsky
(74) *Attorney, Agent, or Firm*—Townsend and Townsend and Crew LLP

(57) ABSTRACT

The invention relates to a closing system for doors having an inner rotary knob associated with an inner side which is rotationally fixedly connected to a closing element for the actuation of a latch and an outer rotary knob. The inner rotary knob is rotationally fixedly connected to a sleeve on which the closing element is rotationally fixedly arranged. The outer rotary knob is rotationally fixedly connected to a shaft which extends through the sleeve of the inner rotary knob and is rotationally fixedly connected to a coupling unit arranged in the inner rotary knob. The coupling unit is freely rotatable in a free wheel state relative to the inner rotary knob and rotationally fixedly coupled to the inner rotary knob in a driving state. Moreover, the coupling unit is connected for the changeover between the free wheel state and the driving state to a code input unit arranged in the outer rotary knob via an electrical and/or optical signal path extending through the shaft of the outer knob.

21 Claims, 1 Drawing Sheet

CLOSING SYSTEM

BRIEF SUMMARY OF THE INVENTION

Figure 1:
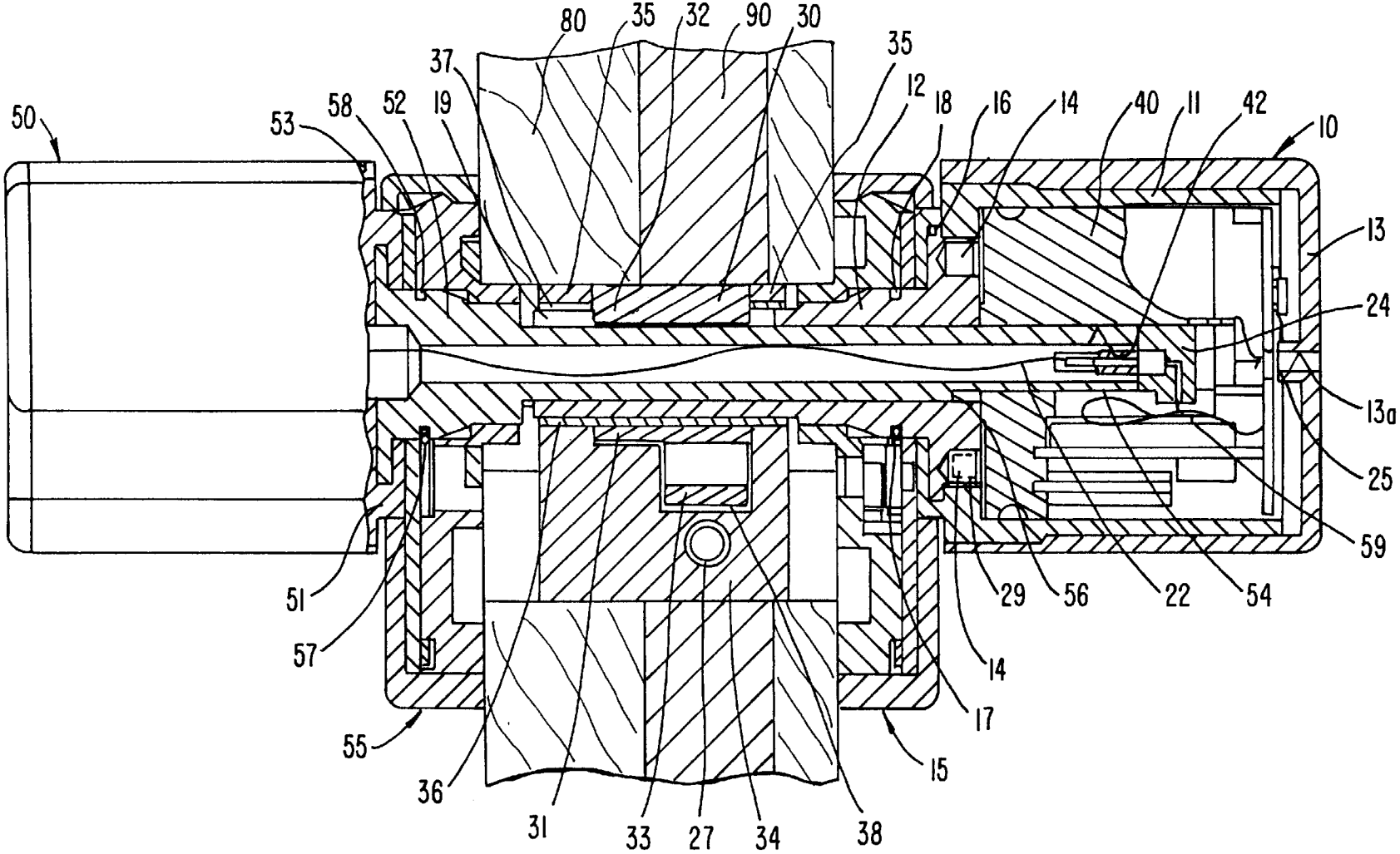

The invention relates to a closing system for doors with an inner rotary knob associated with the inner side of a door and connected to a closing element for the actuation of a latch and an outer rotary knob.

In such closing systems the door can be locked or unlocked from the inner side of the door without a key or any other form of access entitlement by means of the inner rotary knob.

OBJECT OF THE INVENTION

It is an object of the invention to provide a closing system of the initially named kind which makes it possible, with an economic layout, to selectively enable or to prevent the actuation of the latch via the outer rotary knob in a manner which is as simple as possible.

This object is satisfied, in accordance with the invention, by a closing system for doors having an inner rotary knob associated with an inner side of the door and rotationally fixedly connected to a closing element for the actuation of a latch and an outer rotary knob, wherein the inner rotary knob is rotationally fixedly connected to a sleeve on which the closing element is rotationally fixedly arranged, wherein the outer rotary knob is rotationally fixedly connected to a shaft which extends through the sleeve of the inner rotary knob and is rotationally fixedly connected to a coupling unit arranged in the inner rotary knob, which is freely rotatable relative to the inner rotary knob in a free wheel state and rotationally fixedly coupled to the inner rotary knob in a driving state, and wherein the coupling unit is connected, for the changeover between the free wheel state and the driving state, to a code input unit arranged in the outer rotary knob via an electrical and/or optical signal path extending through the shaft of the outer rotary knob.

The passage of the shaft of the outer rotary knob through the sleeve of the inner rotary knob in accordance with the invention and the rotationally fixed connection of the shaft to the coupling unit provided in the inner rotary knob provides a simple and space saving possibility of producing a rotationally fixed connection between the outer rotary knob and the inner rotary knob.

The coupling unit, which is rotationally fixedly connected in accordance with the invention to the shaft of the outer rotary knob, exploits the space which is available within the inner rotary knob in advantageous manner, whereby space is provided for the code input unit in the outer rotary knob.

The exploitation of the shaft in accordance with the invention for the signal path is in particular of advantage when coupling lines, for example cables or light guides, and used, since, on actuation of the rotary knobs, the rotationally fixed coupling between the shaft and the coupling unit prevents the lines being rotated relative to the components in the rotary knobs to which the lines are connected, in particular relative to the coupling unit and the code input unit, and thus prevents them breaking.

Furthermore, in accordance with the invention, the coupling unit and the code input of the closing system are integrated into the rotary knobs so that existing doors can be converted to use the closing system of the invention with comparatively little effort and cost and without changing the optical appearance of the door.

In accordance with a preferred embodiment of the invention the coupling unit is formed as a component of a transponder unit, and the code input unit is formed as a receiver unit of the transponder unit.

In this way a closing system is provided which can be actuated without a customary key and which permits a user with authorized access to rotationally fixedly connect the outer rotary knob to the inner rotary knob simply by transmitting a signal to the receiver unit via a portable transmitter, for example in the form of a cheque chard, and in this way to obtain access.

In accordance with a further preferred embodiment of the invention the sleeve of the inner rotary knob and the shaft of the out rotary knob are axially displaceable relative to one another. In this way a simple and in particular stepless adaptation of the closing system to different door leaf thicknesses is made possible.

In accordance with a further preferred embodiment of the invention the closing element is axially displaceable on the sleeve of the inner rotary knob.

In this manner the closing system can be simply adapted to the axial position of the latch in the door leaf by displacement of the closing element on the sleeve.

In accordance with a further preferred embodiment of the invention the closing element is connected to a cylinder adapter which is rotatable relative to the closing element.

In this way the closing system of the invention can be inserted in place of a customary lock cylinder into the door lock so that the door can be converted to the closing system of the invention in a simple manner.

In accordance with a further preferred embodiment of the invention a cylinder adapter and the closing element are pushed onto a common bearing sleeve, preferably manufactured of plastic, which is axially displaceable on the sleeve of the inner rotary knob.

The cylinder adapter and the closing element are in this arrangement combined by means of the bearing sleeve into a unit in a particularly simple manner.

In accordance with a further preferred embodiment of the invention the closing element, preferably a common bearing sleeve of a cylinder adapter and of a closing element, is capable of being selectively pushed onto the sleeve of the inner rotary knob with its one or other axial end at the front.

As a consequence, with an asymmetrical construction of the closing element, an adaptation to the axial position of the latch in the door leaf can be obtained simply by turning the closing element, i.e. the unit consisting of the cylinder adapter and the closing element, on the sleeve of the inner rotary knob. In particular, this makes it possible to arrange the closing element optionally in the direct vicinity of the inner or outer side of the door.

Further advantageous embodiments of the invention are set forth in the description, in the drawings and in the subordinate claims.

In the following the invention will be described by way of example and with reference to the drawing, the single figure of which shows an axial part section of an embodiment of a closing system in accordance with the invention mounted on a door leaf.

The closing system of the invention shown in the FIGURE comprises an inner rotary knob 10 arranged on the inner side of the door leaf 80 and an outer rotary knob 50. The rotary knobs 10, 50 each have at their side facing away from the door leaf 80 a housing 11, 51 of plastic, which is respectively surrounded by a cover cap 13, 53 likewise consisting of plastic. The cover caps 13, 53 each extend up to a rose 15, 55 connected to the door leaf 80.

The housing 11 of the inner rotary knob 10 is rotationally fixedly connected to a sleeve 12 manufactured of metal, which extends through a lock 90 arranged in the door leaf 80 and ends within the door leaf 80. A hollow shaft 52 likewise consisting of metal and rotationally fixedly connected to the housing 51 of the outer rotary knob 50 extends through the sleeve 12 of the inner rotary knob 10 up to and into the interior of the housing 11.

The axial fixation of the sleeve 12 and of the shaft 52—and thus of the two rotary knobs 10, 50—takes place through fixing springs 17, 57 of the roses 15, 55 which engage into fixing recesses 18, 58 formed in the sleeve 12 and in the shaft 52 in a manner releasable by a tool.

A three-part adapter unit comprising a cylinder adapter 34, a closing element 30 and a bearing sleeve 36 is arranged on the sleeve 12 of the inner rotary knob 10. The cylinder adapter 34 consisting of metal has a cross-sectional shape in a plane parallel to the door leaf 80 which corresponds to that of a customary lock cylinder, for example formed as a profiled cylinder, round cylinder or oval cylinder. Such profiled cylinders are in extensive use in Europe, in particular in Germany, and are, for example, shown in PCT application PCT/DE97/00284 published as WO97/30252, see for example parts 3 and 33 in FIG. 7 and the associated description. The cylinder adapter 34 is inserted into corresponding openings of the door leaf 80 and of the lock 90 and is rotationally fixedly arranged in the lock 90 in this manner.

The closing element 30 likewise consisting of metal includes a sleeve-like bearing section 31, on which a closing nose 33 is formed for the actuation of a non-illustrated latch of the lock. The closing nose 33 terminates flush with the axial end of the sleeve-like bearing section 31 adjacent the inner rotary knob 10 in the arrangement of the FIGURE. The closing element 31 consequently has an asymmetrical construction.

The cylinder adapter 34 and the closing element 30 are mutually rotatably arranged on the bearing sleeve 36 formed of plastic in such a way that the bearing section 31 of the closing element 30 is located between two ring-like bearing sections 35 of the cylinder adapter 34.

A recess 38 for the closing nose 33 is provided in the cylinder adapter 34 and enables a rotation of the closing element 30 relative to the cylinder adapter 34 through 360°. The cylinder adapter 34 is consequently likewise asymmetrically constructed.

The position of the rotary axis of the closing unit of the invention—about which the rotary knobs 10, 50, the sleeve 12, the shaft 52 and the closing element 30 can be turned—is thus determined by the cylinder adapter 34 and the corresponding openings in the door leaf 80 and in the lock 90. The sleeve 12 of the inner rotary knob has a guide slot 19 which extends in the axial direction and is formed as a cut in the sleeve wall starting from the free end of the sleeve 12. The guide slot 19 cooperates with a guide and actuation rib 32 of the closing element 30, which is molded onto the inner wall of the sleeve-like bearing section 31 at the side opposite to the closing nose 33 and extends in the axial direction over the full length of the bearing section 31.

A slot 37 is formed in the bearing sleeve 36 and is formed as a cut which starts from the left hand axial end of the bearing sleeve 36 in the FIGURE. Consequently, the bearing sleeve 36 also has an asymmetrical construction. The guide and actuating rib 32 of the closing element 30 projects through the slot 37 of the bearing sleeve 36 into the guide slot 19 of the inner rotary knob 12 aligned with the slot 37 to such an extent that the guide and actuating rib 32 finished approximately flush with the inner wall of the inner rotary knob sleeve 12.

A cylindrical coupling unit 40 in which a guide passage 42 is formed is arranged within the housing 11 of the inner rotary knob 10. The free end region of the shaft 52 of the outer rotary knob 50, with which the shaft 52 projects into the guide passage 42, is flattened off and thus has a non-circular cross-section which corresponds to the free cross section of the guide passage 42, so that the shaft 52 and thus the outer rotary knob 50 is rotationally fixedly connected to the coupling unit 40.

The maximum depth of insertion of the shaft 52 in the guide passage 42 is determined by an abutment 56, which is formed at the end of the flattened region adjacent the outer rotary knob 50.

A connection element 24 formed as a plug is axially displaceably arranged within the guide passage 42 and is plugged into a socket element 59, which is rotationally fixedly and axially movably connected to the shaft 52 of the outer rotary knob 50. The cross-section of the connection element 24 corresponds to the non-circular cross-section of the shaft 52 and thus to the free cross-section of the guide passage 42 in which the connection element 24 can consequently not turn.

The guide passage 42 and the coupling unit 40 merges before its end face remote from the door leaf 80 into a bore 25 of smaller diameter, which leads outwardly via a bore 13*a* formed in the cover cap 13.

The socket element 59 is connected to a code input unit arranged in the outer knob 50 and covered over in the drawing by its cover cap 53 via an electrical connection line 22 extending through the hollow shaft 52 and comprising the individual signal and supply lines. The code input unit is formed as the receiver unit of a transponder unit and is connected via the connection element 24 to a control and actuating unit of the transponder unit, which is integrated into the coupling unit 40. In this manner the coupling unit 40 is a component of the transponder unit.

Space for a battery unit or a rechargeable accumulator unit for the voltage supply of the closing system is provided in the outer rotary knob 50.

The control and actuating unit comprises, in addition to electronic components, a motor with which a pin-like driver 29 can be actuated, which extends parallel to and displaced relative to the axis of rotation of the closing unit. In the drawing the pin-like driver 29 is actually retracted and thus not usually visible. Its active position is, however, indicated by a broken line for the sake of a easier understanding of the arrangements. The connection line 22 serves for the voltage supply of the motor.

By means of the motor the driver can be moved to and fro between a driving position and a free running position, with the driver being in engagement with recesses 14 in its driving position and out of engagement with recesses 14 in its free running position.

The recesses 14 are each provided in the form of a bore in a driver disc 16 connected in one piece with the sleeve 12 of the inner rotary knob 10. A plurality of such recesses 14 is arranged distributed in the peripheral direction in the region of the rim of the driver disc 16. The driver disc 16 forms an end face region of the housing 11 and a contact surface for the coupling unit 40 arranged therein.

Consequently, the coupling unit 40 can be selectively brought into a driving state or into a free running state by means of a motor, with the coupling unit being in a driving state when the driver projects into one of the recesses 14, which permits a rotation of the inner rotary knob 10 and thus of the closing nose 33 by means of the outer rotary knob 50.

A non-illustrated movement sensor arranged in the coupling unit 40 is formed to detect the rotary movement of the coupling unit and, by making a corresponding signal available, serves to block an axial movement of the driver between its driving and free running states when the coupling unit is turning.

The manner of operation of the closing system of the invention is as follows:

The sleeve 12 of the inner rotary knob 10 is pushed, with the adapter unit pushed onto it, into the openings of the door leaf 80 and of the lock 90 provided for this unit the fixing spring 17 of the rose 15 snaps into the fixing recess 18 of the sleeve 12.

In this respect the asymmetrical design of the adapter unit consisting of the cylinder adapter 34, the closing element 30 and the bearing sleeve 36 permits the adapter unit to be selectively pushed, prior to the introduction into the lock 90, onto the sleeve 12 of the inner rotary knob 10, with either the closing nose 33 or the oppositely disposed axial end of the closing element 30 at the front.

In this way the closing system of the invention can be used with doors, in which the lock 90 is arranged close to one of the side faces of the door leaf 80, and indeed independently of whether this is the outer side or the inner side of the door leaf 80.

In the arrangement in accordance with the drawing, the door leaf 80 is thinner at the side of the lock 90 adjacent the inner rotary knob 10 than at the oppositely disposed side so that the closing element 30 is arranged on the sleeve 12 in such a way that its closing nose 33 is adjacent the inner side of the door.

Thereafter the adapter unit is brought into the desired axial position on the sleeve 12, on which the closing nose 33 can actuate the latch of the lock 90. This can, for example, be achieved by a customary locking screw with a conical end, which is inserted from the side edge of the door and engages with the threaded bore 27 in the profiled lock cylinder, the conical end causing movement of the adapter unit along the sleeve 12.

For this purpose the adapter unit can be simply pushed to and fro on the sleeve 12, with the bearing sleeve 36 sliding along the outer wall of the sleeve 12 and the guide and actuating rib 32 of the closing element 30 being guided by the guide slot 19 of the sleeve 12. Then the shaft 52 of the outer rotary knob 50 is passed through the sleeve 12, and its free end is pushed into the guide passage 42 of the coupling unit 40 until the fixing spring 57 of the rose 55 snaps into the fixing recess 58 of the shaft 52.

In order to establish the electrical plug connection between the socket element 59 mounted at the free end of the shaft 52 and the connection element 24 arranged in the guide passage 42, the connection element 24 can be actuated from the outside with a counter-holding tool, which can be pushed through the bore 13*a* of the cover cap 13 and the before 25 of the coupling unit 40.

The correct relative alignment of the socket element 59 and of the connection element 24 is ensured by the non-circular cross-sections of the shaft 52, of the guide passage 42 and of the connection element 24 and permits the insertion of the shaft 52 into the sleeve 12 only when it has the correct relative angular orientation.

The abutment 56 of the shaft 52 prevents the shaft 52 penetrating too far into the coupling unit 40 with small door thicknesses and presses the connection element 24, for example, against a circuit board or other electronic components which are arranged in the region of the side of the coupling unit 40 facing away from the door leaf 80.

The axial displaceability of the adapter unit on the sleeve 12, the possibility of turning the asymmetrically constructed adapter unit and also the telescopic plugging together of the sleeve 12 and of the shaft 52 thus enables an adaptation of the closing system of the invention both to different door leaf thicknesses and also to different axial positions of the lock 90 within the door leaf 80.

This adaptation is effected in the above described manner simply during the assembly of the closing system while it is being attached to the door leaf, with none of the components of the closing system having to be constructionally altered in any way for this adaptation.

By rotation of the inner rotary knob 10 the closing element 30 is taken with it via the guide 19 formed in its sleeve 12 and the guide and actuating rib 32 of the closing element 30, and in this manner is likewise rotated relative to the cylinder adapter 34 together with the bearing sleeve 36 which is likewise driven via the guide and actuating rib 32. In this manner the latch of the lock 90 can be actuated via the closing nose 33 and the door can be locked and unlocked at any time by means of the inner rotary knob 10.

The code input in the outer rotary knob 50 formed as the receiver unit of the transponder unit responds to an entitlement code, for example in the form of a radiosignal or inductive signal, which can be transferred to the receiver unit via a transmitter, which can basically be formed in any desired manner.

The transmitter can, for example, be carried by a person with authorized access, for example in the form of a cheque card.

On receipt of the entitlement code, the motor of the coupling unit 40 is controlled by the receiver unit via the connection line 22 in order to change from the free running state into the driving state, i.e. in order to either enable or prevent an actuation of the latch of the lock 90 via the outer rotary knob 50.

The motion sensor of the coupling unit 40 formed to detect rotary movement ensures that a transfer of the driver from its driving position into its free running position or vice versa does not take place as long as the coupling unit 40 is turning. The motion sensor can, for example, be a proximity sensor which senses the passage of a metallic component within the lock.

This is, for example, of advantage when the closing system is provided with an automatic time control which ensures, after the expiry of a predetermined time interval, following the transfer of the coupling unit 40 into the driving position, that the driver is automatically moved back into its free running position. This automatic decoupling of the outer rotary knob 50 and of the inner rotary knob 10 can be prevented by the motion sensor when an authorized person actuates the outer rotary knob 50 after the end of this time interval.

In the above described embodiment of the closing system of the invention an electrical signal path in the form of the connection line 22 consequently extends through the hollow shaft of the outer rotary knob 50. As an alternative an optical signal path, for example in the form of light guides, can also be provided.

Instead of the described transponder unit basically any desired code input unit which is able to convert a coded signal into electrical or optical signals can basically be used in the closing system of the invention, together with a coupling unit which can be controlled by means of these signals and thereby changed over between the driving state and the free running state. The code input unit could, for example, be designed to distinguish fingerprints or other individual body features and only then permit a changeover of the coupling unit when the fingerprint or another body feature of a person with authorized access is identified.

REFERENCE NUMERAL LIST

10 inner rotary knob
11 housing
12 sleeve
13 cover cap
13*a* bore
14 recesses
15 rose
16 driver disc
17 fixing spring
18 fixing recess
19 guide slot
22 connection line
24 connection element
25 bore
30 closing element
31 bearing section of the closing element
32 guide and actuating rib
33 closing nose
34 cylinder adapter
35 bearing sections of the cylinder adapter
36 bearing sleeve
37 slot of the bearing sleeve
38 recess of the cylinder adapter
40 coupling unit
42 guide passage
50 outer rotary knob
51 housing
52 shaft
53 cover cap
54 region of non-circular cross-section
55 rose
56 abutment
57 fixing spring
58 fixing recess
59 socket element
80 door leaf
90 lock

What is claimed is:

1. A closing system for doors having an inner rotary knob (10) adapted to be mounted on an inner side of the door and connected to a closing element (30) for the actuation of a latch and on outer rotary knob (50), wherein the inner rotary knob (10) is rotationally fixed with respect to a sleeve (12) on which the closing element (30) is rotationally fixed wherein the outer rotary knob (50) is rotationally fixed with respect to a shaft (52) which extends through the sleeve (12) of the inner rotary knob (10) and is rotationally fixed with respect to a coupling unit (40) arranged in the inner rotary knob (10), which is freely rotatable relative to the inner rotary knob (10) in a free wheel state and is coupled so as to be rotationally fixed with respect to the inner rotary knob (10) in a driving state, and wherein the coupling unit (40) is connected, for the changeover between the free wheel state and the driving state, to a code input unit arranged in the outer rotary knob (50) via an electrical and/or optical signal path extending through the shaft (52) of the outer rotary knob (50).

2. The closing system in accordance with claim 1, wherein the coupling unit (40) is formed as a component of a transponder unit and the code input unit is formed as a receiver unit of the transponder unit.

3. The closing system in accordance with claim 1, wherein the shaft (52) of the outer rotary knob (50) has a non-circular cross-section corresponding to the free cross-section of a guide channel (42) of the coupling unit (40), at least in a region extending in the guide channel (42) of the coupling unit (40).

4. The closing system in accordance with claim 1, wherein the sleeve (12) of the inner rotary knob (10) and the shaft (52) of the outer rotary knob (50) are axially displaceable relative to one another.

5. The closing system in accordance with claim 1, wherein a releasable connection can be established between the free end of the shaft (52) of the outer rotary knob (50) and a connection element (24) arranged in a guide channel (42) of the coupling unit (40), with the free end of the shaft (52) of the outer rotary knob (50) being formed as a socket and the connection element (24) as a plug.

6. The closing system in accordance with claim 1, wherein a connection element (24) which can be coupled to the free end of the shaft (52) of the outer rotary knob (50) is axially displaceably arranged in a guide channel (42) of the coupling unit (40).

7. The closing system in accordance with claim 1, wherein the code input unit is arranged at least partly in a housing (51) manufactured in particular of plastic which is connected in a rotationally fixed manner to the shaft (52) of the outer rotary knob (50).

8. The closing system in accordance with claim 1, wherein the coupling unit (40) is approximately cylindrically designed and is arranged at least partly in a housing (11) rotationally fixedly connected to the sleeve (12) of the inner rotary knob (10), with the free cross-section of the housing corresponding approximately to the cross-section of the coupling unit (40).

9. The closing system in accordance with claim 1, wherein the coupling unit (40) includes at least one pin-like driver which is axially movable between a free wheel position and a driving position, with the driver engaging into a recess (14) of the sleeve (12) in the driving position.

10. The closing system in accordance with claim 1, wherein at least one recess (14) is distributed in the circumferential direction for a driver of the coupling unit (40) formed in a driver disk (16) which is fixedly connected to the sleeve (12) of the inner rotary knob (10) and forms one end face region of a cylindrical housing (11) for the coupling unit (40).

11. The closing system in accordance with claim 1, wherein the coupling unit (40) includes a movement sensor which is formed to detect a rotary movement of the coupling unit (40) and to lock an axial movement of a driver (29) of the coupling unit (40) during such a rotary movement.

12. The closing system in accordance with claim 1, wherein an abutment (46) is formed on the shaft (52) of the outer rotary knob (50) and cooperates with a region of the coupling unit (40) which bounds an insertion opening of a guide channel (42).

13. The closing system in accordance with claim 1, wherein at least one fixing recess (18, 58) formed as a peripheral groove, is formed on the sleeve (12) of the inner rotary knob (10) and/or on the shaft (52) of the outer rotary knob (50) and can be respectively releasably brought into engagement with a lock plate or a rose (15, 55) of the door for the axial fixation of the inner rotary knob (10) and of the outer rotary knob (50).

14. The closing system in accordance with claim 1, wherein the closing element (30) is axially displaceable on the sleeve (12) of the inner rotary knob (10).

15. The closing system in accordance with claim 1, wherein a guide slot (19) extending in the axial direction is formed in the wall of the sleeve (12) of the inner rotary knob (10) for a guide and actuating rib (32) of the closing element (30).

16. The closing system in accordance with claim 1, wherein the closing element (30) is connected to a cylinder adapter (34) which is rotatable relative to the closing element (30).

17. The closing system in accordance with claim 1, wherein the closing system (30) is closer to one axial end of a cylinder adapter (34) than to its other axial end.

18. The closing system in accordance with claim 1, wherein a cylinder adapter (34) and the closing element (30) are pushed onto a common bearing sleeve (36), which is axially displaceable on the sleeve (12) of the inner rotary knob (10).

19. The closing system in accordance with claim 1, wherein the closing element (30) is a common bearing sleeve (36) of a cylinder adapter (34) and of the closing element (30).

20. The closing system in accordance with claim 1, wherein a cylinder adapter (34) has two in particular ring-like bearing sections (35) respectively pushed onto an axial end of a bearing sleeve (36) between which a bearing section (31) of the closing element (30) pushed onto the bearing sleeve (36) is arranged.

21. The closing system in accordance with claim 1, wherein a guide and actuating rib (32) of the closing element (30) cooperating with a guide slot (19) of the sleeve (12) of the inner rotary knob (10) is formed on a bearing section (31) of the closing element (30) and passes through a slot (37) of a bearing sleeve (36) into the interior of the bearing sleeve (36).

* * * * *